US007874721B2

(12) United States Patent
Miyano et al.

(10) Patent No.: US 7,874,721 B2
(45) Date of Patent: Jan. 25, 2011

(54) MIXING ELEMENT

(75) Inventors: Tatsunosuke Miyano, Tokyo (JP); Masayuki Takahashi, Tokyo (JP); Kazuma Noguchi, Soka (JP)

(73) Assignee: GC Corporation, Tokyo (JP)

( * ) Notice: Subject to any disclaimer, the term of this patent is extended or adjusted under 35 U.S.C. 154(b) by 686 days.

(21) Appl. No.: 11/941,374

(22) Filed: Nov. 16, 2007

(65) Prior Publication Data

US 2008/0117715 A1 May 22, 2008

(30) Foreign Application Priority Data

Nov. 16, 2006 (JP) ..... 2006-310463

(51) Int. Cl.
*B01F 5/06* (2006.01)

(52) U.S. Cl. ..... 366/339; 138/42

(58) Field of Classification Search ..... 366/181.5, 366/339; 138/42; 48/189.4
See application file for complete search history.

(56) References Cited

U.S. PATENT DOCUMENTS

| | | | | |
|---|---|---|---|---|
| 3,286,992 | A * | 11/1966 | Armeniades et al. | 366/339 |
| 3,635,444 | A * | 1/1972 | Potter | 366/339 |
| 3,953,002 | A | 4/1976 | England, Jr. et al. | |
| 4,408,893 | A | 10/1983 | Rice, III | |
| 4,850,705 | A | 7/1989 | Horner | |
| 5,174,653 | A * | 12/1992 | Halat et al. | 366/339 |
| 5,985,045 | A | 11/1999 | Kobayashi | |
| 6,840,281 | B1 * | 1/2005 | Amidzich | 138/42 |

FOREIGN PATENT DOCUMENTS

| | | |
|---|---|---|
| EP | 0 360 371 A2 | 3/1990 |
| JP | 2890314 | 2/1999 |
| WO | WO 94/05412 | 3/1994 |

OTHER PUBLICATIONS

U.S. Appl. No. 12/494,924, filed Jun. 30, 2009, Miyano, et al.

* cited by examiner

*Primary Examiner*—David L Sorkin
(74) *Attorney, Agent, or Firm*—Oblon, Spivak, McClelland, Maier & Neustadt, L.L.P.

(57) ABSTRACT

To minimize an amount of unmixed fluids remaining inside, the mixing element includes right-handed and left-handed spiral blades (1) having a shape twisted 180 degrees and being alternately and continuously provided in the axial direction to make end parts (1*a*) of the adjacent spiral blades to orthogonally cross, turbulence generating parts (1*c*) divided by an extension face (1*ca*) ad a rising face (1*cb*) are formed at four portions, which continue toward a front-side side edge (1*a*L1) and an outer periphery at a part spirally continuing to the back side from the front-side side edge (1*a*L1) and are surrounded by a front-side end edge (1*c*L1), an axial-side edge (1*c*L2) and a front-side edge (1*c*R1), and an inflow part (1*d*) formed by notching a portion from an end-part starting edge to a back-side end edge is formed at a back-side side edge opposed to positions of the turbulence generating part (1*c*).

2 Claims, 3 Drawing Sheets

MIXING ELEMENT

BACKGROUND OF THE INVENTION

1. Field of the Invention

The present invention relates to a mixing element of a static mixer fixed in a cylindrical casing and including right-handed spiral blades and left-handed spiral blades, which respectively have a shape twisted approximately 180 degrees, and are alternately and continuously provided in an axial direction so as to make end parts of the adjacent spiral blades to cross almost orthogonally.

2. Description of the Conventional Art

When two or more kinds of fluid are mixed, a static mixer not having a driving part has been conventionally widely used. For example, U.S. Pat. No. 3,953,002, and U.S. Pat. No. 4,408,893 disclose such a static mixer including a cylindrical casing and a mixing element fixed in the casing, where the mixing element includes right-handed spiral blades and left-handed spiral blades, which respectively have a shape twisted approximately 180 degrees, and are alternately and continuously provided in an axial direction so as to make end parts of the adjacent spiral blades to cross almost orthogonally.

As for the static mixer, when two or more kinds of fluids flow continuously into a cylindrical casing, in which a mixing element is fixed, from one side of the casing, two or more kinds of the continuously flowing-in fluids flow toward the other side of the casing in a space formed with an inner peripheral face of the casing and two or more spiral blades of the mixing element. During this process, the fluids are continuously stirred and mixed by operations of dividing, converting, and reversing by two or more spiral blades of the mixing element and a mixture of two or more kinds of the fluids is discharged from the other side of the casing. Further, in the static mixer, by changing the number or diameter of a spiral blade of a mixing element, the mixer can be used for mixing of various kinds of fluids, e.g., mixing of fluids having low viscosity or mixing of fluids having high viscosity.

In the static mixer, since two or more kinds of fluids flow into a casing, in which a mixing element is fixed, continuously from one side of the casing, these fluids can be mixed without using a means such as a driving part. However, two or more kinds of fluids finally remain unmixed in a space formed with an inner peripheral face of the casing and two or more spiral blades of the mixing element, and thus there is a fault that the remaining fluids become wastes. More particularly, when two or more kinds of the fluids are, for example, a high cost material constituting a dental adhesive, there is a fault that the economic loss is remarkably high.

Then, in order reduce the residual amount of two or more kinds of unmixed fluids in the static mixer, Japanese Patent No. 2890314 discloses a mixing element including main faces which are spirally and symmetrically twisted around a longitudinal axis and opposes to each other. The main faces have such structure that a cross section of a baffle which vertically cross with the above-mentioned axis has a recess shape, and extend along the longitudinal axis from a first end part to a second end part of the baffle.

When the baffle is provided in a tubular housing, the recessed faces of the main faces can demarcate one pair of paths, which has an approximately egg shape or ellipse shape and does not have an acute angle part, with the housing on each side of the baffle.

This mixing element has recessed faces extending along the axial direction from a first end part to a second end part of a baffle (that is, a spiral blade), and one pair of paths having an approximately egg shape or ellipse shape without having an acute angle part are demarcated on each side of the spiral blade. Thus, even when each side of the spiral blade has an a cuter angle, that is, even when the length in the axial direction of the spiral blade is slightly shortened than that of a conventional mixing element, this mixing element can obtain similar mixing efficiency to that of the conventional mixing element. However, there is a fault that mixing efficiency for each spiral blade hardly differs from mixing efficiency of a spiral blade of a conventional mixing element, so that this mixing element needs the same number of spiral blades as those of the conventional mixing element. Thus, since the length in the axial direction cannot be remarkably shortened than that of the conventional mixing element, there is a fault that the residual amount of two or more kinds of unmixed fluids cannot be reduced as much as possible.

SUMMARY OF THE INVENTION

The present invention solves the above-described conventional faults, and an objective of the present invention is to provide a mixing element capable of reducing the amount of two or more kinds of unmixed fluids remained in a space formed between an inner peripheral face of a casing and two or more spiral blades of the mixing element as much as possible.

The present inventors carried out earnest works to solve the above-described problems and, as a result, they found out the followings to complete the present invention. A turbulence generating part divided with a face having a form in which the width of the face decreases toward the back side on a front-side outer peripheral edge from the front-side side edge and a face which rises in an approximately vertical direction from the face having the above-described form is formed at each of four portions which spirally continue to the back side from a front-side side edge of each spiral blade and respectively continue to an outer periphery and the font-side side edge, when a linear side edge of an end part of each spiral blade of a mixing element is seen in a direction which is vertical with respect to the side edge and an axial line. Further, an inflow part which is notched so as to smoothly guide the flow of fluid along a spiral face adjacent to each turbulence generating part is formed at a side of a back-side side edge opposing to a portion where each turbulence generating part of an end part of the spiral blade is positioned. Furthermore, angles of the turbulence generating part and the inflow part with respect to an end part of the spiral blade are formed so as to easily flow each fluid along each face. By taking such structure, fluid flowing-in from an end part at one side divides into a flow along the turbulence generating part and a flow along the spiral face adjacent to the turbulence generating part. Further, turbulence generates because a flowing rate of the flow along the turbulence generating part increases toward the back side on the front-side outer peripheral edge, and the flow collides with an inner peripheral face of a casing so as to change the flowing direction, and joins again with a flow along the spiral face adjacent to the turbulence generating part while colliding with it. Then, the joined flow re-divides into a flow along the turbulence generating part and a flow along the spiral face adjacent to the turbulence generating part by a turbulence generating part formed on another side, and reaches to a spiral blade continuously provided at an end part of another side in the state that the turbulence generates. Therefore, since efficiency to mix two or more kinds of fluids is remarkably improved, these fluids can be mixed by the smaller number of spiral blades in comparison with a conventional mixing element. Thus, since an overall length in the axial direction of a mixing element can be remarkably shortened, the amount of two or more kinds of unmixed fluids remaining in a space formed between an inner peripheral face of a casing and spiral blades of the mixing element can be reduced as much as possible.

The present invention is a mixing element of a static mixer fixed in a cylindrical casing and including right-handed spiral blades and left-handed spiral blades, which respectively have a shape twisted approximately 180 degrees in an axial direction and are alternately and continuously provided in an axial direction so as to make end parts of the adjacent spiral blades to cross almost orthogonally.

In the mixing element, a turbulence generating part divided by an extension face which extends from a front-side outer peripheral edge, a straight line, or a smoothly curved line, where the front-side outer peripheral edge is at the side continuing toward the back side, the straight line connects a starting end of a front-side end edge and a back-side end of an axial-side edge, and the smoothly curved line is positioned between the front-side outer peripheral edge at the side continuing toward the back side and the straight line connecting a starting end of the front-side end edge and the back-side end of the axial-side edge and connects a starting end of the front-side end edge and the back-side end of the axial-side edge, when seen in a direction parallel with respect to a side edge of the end part of the spiral blade and vertical with respect to the axial line, and a rising face which rises in an approximately vertical direction with respect to the extension face from the axial-side edge of the extension face, is formed at each of four portions, which respectively continue toward a front-side side edge and an outer periphery at a part spirally continuing to the back side from the front-side side edge of each spiral blade, when a linear side edge of an end part of each spiral blade of a mixing element is seen in a direction which is vertical with respect to the side edge and an axial line, and are surrounded with a front-side end edge positioned at the front-side side edge, where the front-side end edge starts from a front-side outer peripheral edge at a side continuing toward the back side and finishes with a length of ⅛ or more and less than ½ of a diameter of the spiral blade, an axial-side edge connecting an end of the front-side end edge and a back-side end positioned on the front-side outer peripheral edge having a length of ¼ or more and less than ⅓ of the length in the axial direction of the spiral blade from the end part, and a front-side edge of an outer peripheral face at the side continuing toward the back side, where the front-side edge starts from a starting end of the front-side end edge and finishes at a back-side end of the axial-side edge.

Further, an inflow part is respectively formed at each back-side side edge opposed to a portion at which the turbulence generating part of an end part of the spiral blade is positioned. The inflow part is formed by notching a portion from an end-part starting edge, which is positioned on the plane face of the end part, starts from an outer peripheral face at a side continuing toward the back side, finishes with a length of less than ½ of a diameter of the spiral blade, is positioned at a length of less than ½ of a thickness of the end part from the back-side side edge, and is in parallel with a back-side side edge, to a back-side end edge, which is positioned on a back-side spiral face, starts from on the back-side outer peripheral edge positioned at a side continuing toward the back side and having a length of less than ⅙ of a length in the axial direction of the spiral blade from the end part, finishes with an approximately same length as that of the end-part starting edge, and is in approximately parallel with the end-part starting edge.

Furthermore, an angle formed with the plane face of the end part of the spiral blade and a tangent line at a starting edge of the front-side end edge of the front-side edge at the side continuing toward the back side of the turbulence generating part of the spiral blade and an angle formed with the plane face of the end part of the spiral blade and a tangent line at a starting end of an end-part starting edge of the back-side edge of each inflow part starting from a starting end of the end-part starting edge at the side continuing toward the back side of each inflow part of the spiral blade and finishing at a starting end of the back-side end edge are formed so as to be 140° or more and 45° or less.

Further, present inventors also found out that, in the mixing element of the present invention, when an angle formed with an end-part plane face of the spiral blade and a tangent line at an end of a front-side end edge of an edge at the spiral face side, which is positioned at the side opposite to an axial-side edge of the rising face of each turbulence generating part of the spiral blade, starts from the end of the front-side end edge and finishes the back-side end, is made to be 60° or more and less than 90°, efficiency to mix two or more kinds of fluids can be more improved, and such is preferable.

A mixing element according to the present invention has the above-described constitution. Thus, fluid flowing-in from an end part at one side is largely divided into two flows by an end part of a spiral blade at first. Then, the fluid flowing in each of two sides is further divided into a flow along a turbulence generating part and a flow along a spiral face adjacent to the turbulence generating part. As for the fluid to flow along the spiral face adjacent to the turbulence generating part, a part of the fluid is smoothly guided to the spiral face adjacent to the turbulence generating part along an inflow part from a portion near the end part, thereafter joins with another flow along the spiral face adjacent to the turbulence generating part, and flows along the spiral face. On the other hand, as for the fluid to flow along the turbulence generating part, since front-side end edge of the turbulence generating part is not positioned between a front-side side edge and a back-side side edge of the end part but positioned at the front-side side edge of the end part, the fluid does not directly flow in the axial direction but flows along an extension face of the turbulence generating part from the front-side end edge of the turbulence generating part. Then, since the extension face of the turbulence generating part has a shape having the width gradually reduced from the front-side end edge to one point of the back-side end, the fluid flowing along the extension face of the turbulence generating part from the front-side end edge of the turbulence generating part increases its flowing rate until reaching to the back-side end. Further, this fluid collides with an inner peripheral face of a casing from the back-side end so as to change the flowing direction. Thus, when the flow along the turbulence generating part, which has the high flowing rate and the changed flowing direction, re-joins with a flow along the spiral face adjacent to the turbulence generating part at a portion near the back-side end of the turbulence generating part, big turbulence can be generated by colliding of flow along the turbulence generating part with the flow along the spiral face adjacent to the turbulence generating part. Therefore, efficiency to mix two or more kinds of fluids can be remarkably improved.

Further, as for the mixing element according to the present invention, an angle formed with an end-part plane face of the spiral blade and a tangent line at a starting edge of a front-side end edge of a front-side edge at the side continuing toward the back side of the turbulence generating part of the spiral blade and on angle formed with a plane face of an end part of the spiral blade and a tangent line at a starting end of an end-part starting edge of a back-side edge of each inflow part starting from a starting end of the end-part starting edge at the side continuing toward the back side of each inflow part of the spiral blade and finishing at a starting end of a back-side end edge are formed in such a suitable angles that fluids to flow along the turbulence generating part and the inflow part easily flow along the respective faces. Thus, when the flow along the turbulence generating part and the flow along the spiral face adjacent to the turbulence generating part collide at a portion near the back-side end of the turbulence generating part, stronger turbulence can be generated. Therefore, even when the flowing rate of fluids flowing-in from the end part at one side is relatively low, two or more kinds of fluids can be accurately and efficiently mixed.

Further, since the mixing element according to the present invention can be remarkably improved in efficiency to mix two or more kinds of fluids by each spiral blade in comparison with a conventional mixing element, the number of spiral blades can be reduced than that of a conventional mixing element. Thus, the overall length in the axial direction of the mixing element can be remarkably shortened, so that the amount of two or more kinds of unmixed fluids remaining in a space formed between an inner peripheral face of a casing and two or more spiral blades of the mixing element can be reduced as much as possible. Further, more particularly, when two or more kinds of the fluids are a high cost material constituting, for example, a dental adhesive, economic loss can be remarkably reduced.

Furthermore, in a mixing element in the present invention, an angle formed with an end-part plane face of a spiral blade and a tangent line at an end of a front-side end edge at an edge on the spiral face side, which is positioned on the side opposite to an axial-side edge of a rising face of a turbulence generating part of the spiral blade, starts from the end of the front-side end edge, and finishes at the back-side end, is made to be 60° or more and less than 90°. In such the range of angle, an angular difference between the angle formed with the end-part plane face and the extension face of the turbulence generating part, and the angle formed with the end-part plane face and the spiral face adjacent to the extension face of the turbulence generating part can be more increased. Thus, fluid flowing-in from an end part at one side can be effectively divided into two flows, that is, the flow along the turbulence generating part and the flow along the spiral face adjacent to the turbulence generating part. Therefore, efficiency to mix two or more kinds of fluids can be more improved, and such is preferable.

DETAILED DESCRIPTION OF PREFERRED EMBODIMENT

A mixing element according to the present invention will be described in detail below with reference to drawings.

Figure 1:
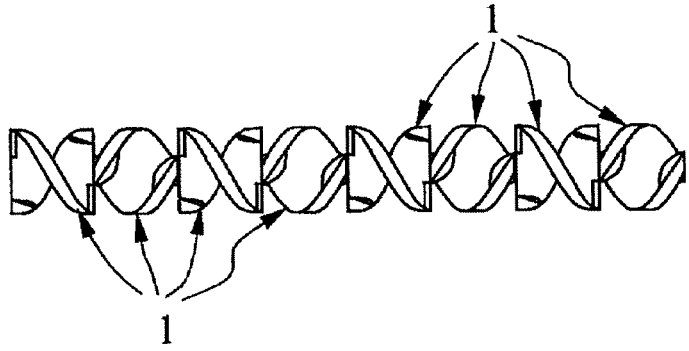
FIG. 1 is a side explanatory view to illustrate one example of a mixing element according to the present invention.
Figure 2:
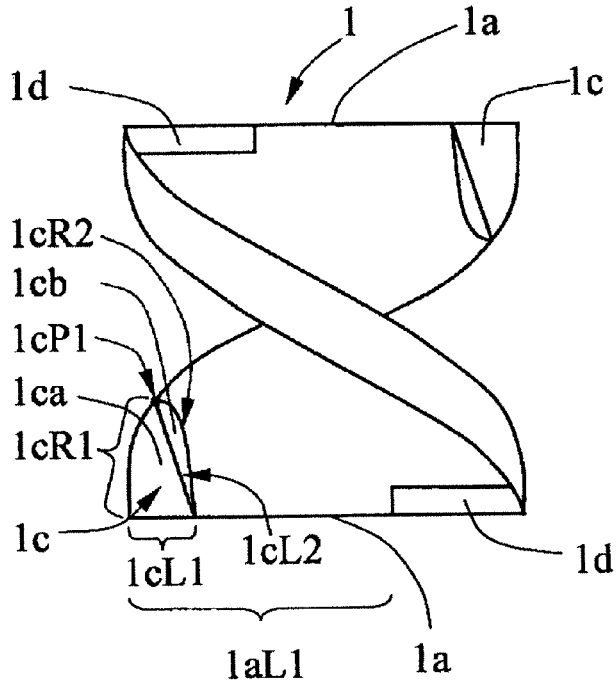
FIG. 2 is a side explanatory view when an example of a left-handed spiral blade of a mixing element according to the present invention is seen in a direction which is vertical with respect to a side edge of an end part of the example and an axial line.
Figure 3:
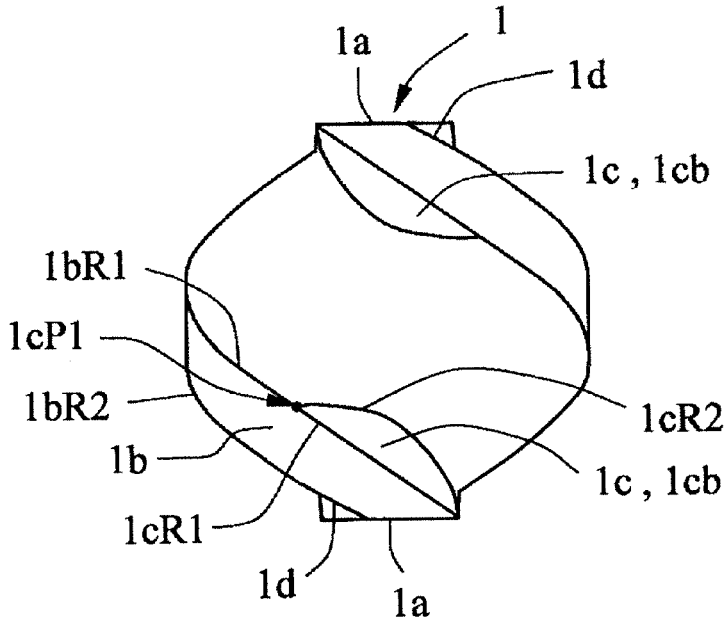
FIG. 3 is a side explanatory view when the example of a left-handed spiral blade illustrated in FIG. 2 is seen in a direction which is parallel with respect to a side edge of an end part of the example and vertical with respect to an axial line.
Figure 4:
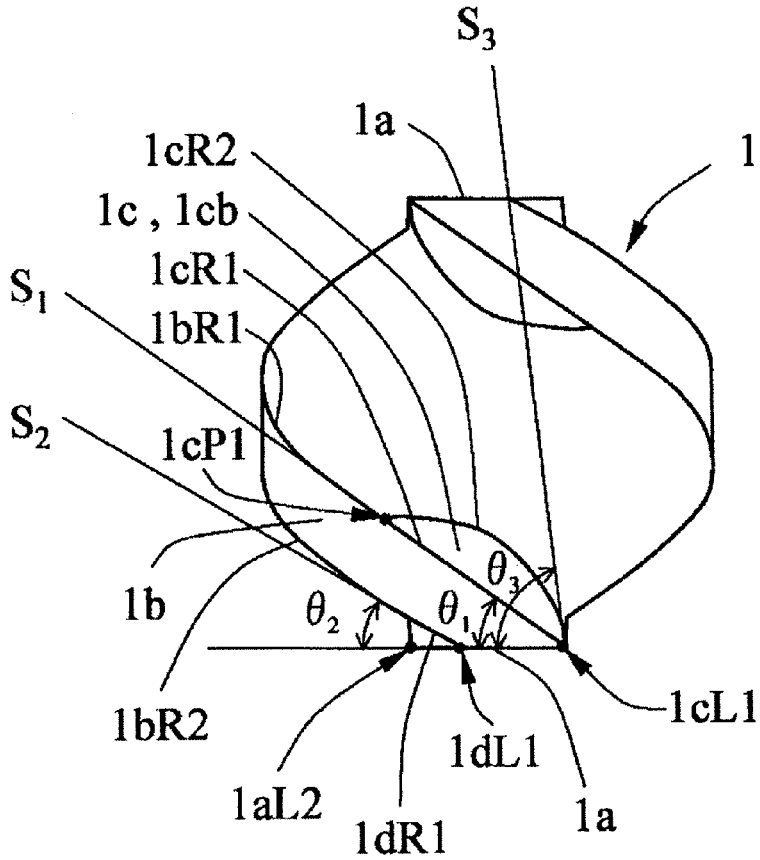
FIG. 4 is a side explanatory view to schematically illustrate angles formed with an end-part plane face and a tangent line of a front-side edge of a turbulence generating part and a tangent line of a back-side edge of an inflow part respectively in FIG. 3.
Figure 5:
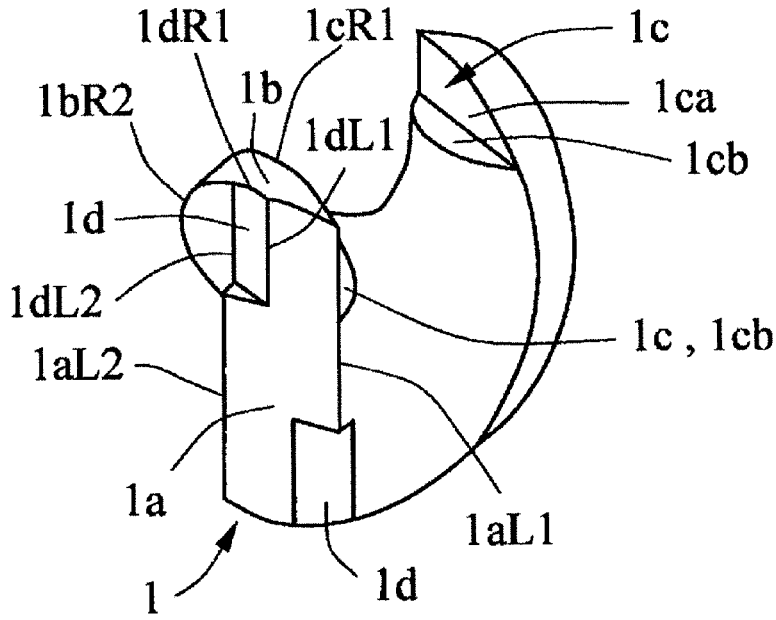
FIG. 5 is a perspective explanatory view when the left-handed spiral blade illustrated in FIG. 2 is seen from an end part side thereof.
Figure 6:
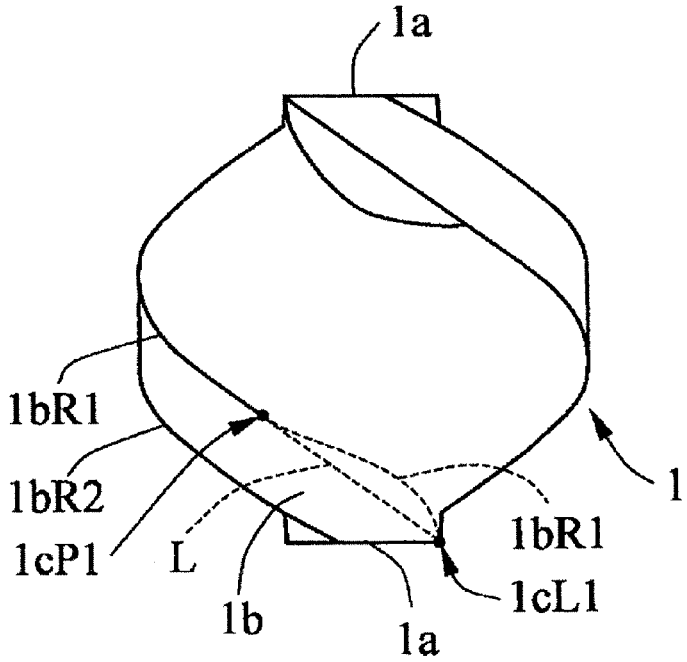
FIG. 6 is a side explanatory view to schematically illustrate a positional relationship of a front-side edge at the turbulence generating part of a left-handed spiral blade of a mixing element according to the present invention.
Figure 7:
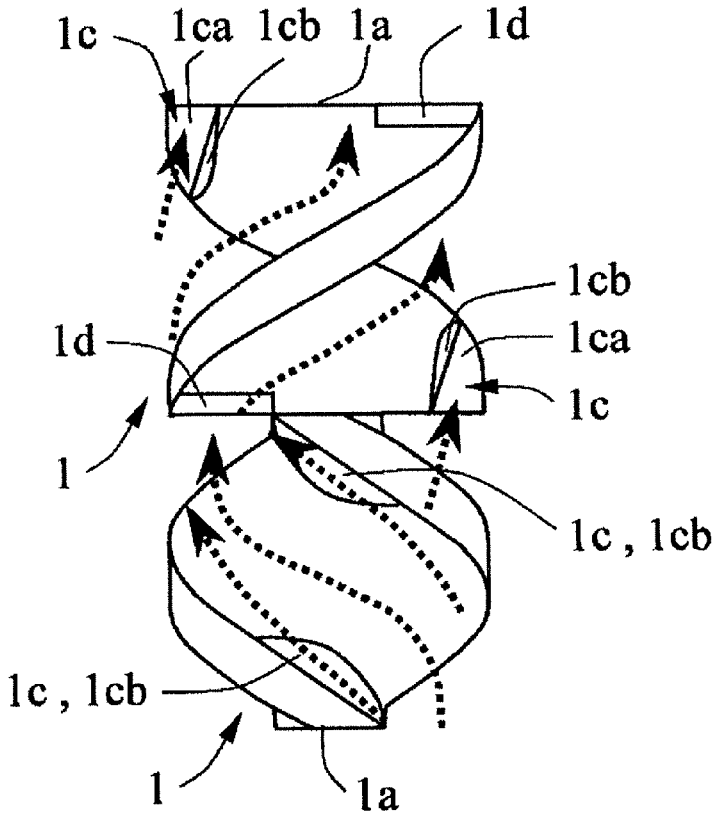
FIG. 7 is a side explanatory view to schematically illustrate flows of fluid in a mixing element according to the present invention.

FIG. 1 is a side explanatory view to illustrate one example of a mixing element according to the present invention. FIG. 2 is a side explanatory view when an example of a left-handed spiral blade of a mixing element according to the present invention is seen in a direction which is vertical with respect to a side edge of an end part of the example and an axial line. FIG. 3 is a side explanatory view when the example of a left-handed spiral blade illustrated in FIG. 2 is seen in a direction which is parallel with respect to a side edge of an end part of the example and vertical with respect to an axial line. FIG. 4 is a side explanatory view to schematically illustrate angles formed with an end-part plane face and a tangent line of a front-side edge of a turbulence generating part and a tangent line of a back-side edge of an inflow part respectively in FIG. 3. FIG. 5 is a schematic explanatory view when the left-handed spiral blade illustrated in FIG. 2 is seen from an end part side thereof. FIG. 6 is a side explanatory view to schematically illustrate a positional relationship of a front-side edge at the turbulence generating part of a left-handed spiral blade of a mixing element according to the present invention. FIG. 7 is a side explanatory view to schematically illustrate flows of fluid in a mixing element according to the present invention.

In the drawings, right-handed and left-handed spiral blades 1 respectively have a shape twisted approximately 180 degrees around an axial direction.

As illustrated in FIG. 1, a mixing element of a static mixer is constituted by alternately and continuously providing the right-handed spiral blade 1 and the left-handed spiral blade 1 in the axial direction so as to cross end parts 1*a* of the adjacent spiral blades 1 almost vertically.

The number of the spiral blades 1 constituting the mixing element may be at least one pair of right-handed and left-handed spiral blades 1, 1. The number can be properly increased according to various conditions, e.g., viscosity and property of two or more kinds of fluids to be mixed, or the flowing rate of two or more kinds of fluids flowing into a casing.

Further, when a mixing element is constituted by continuously providing the spiral blades 1, 1, so as to place the right-handed spiral blade 1 and the left-handed spiral blade 1 alternately in the axial direction and to, cross end parts 1*a* of the adjacent spiral blades 1 almost vertically, these spiral blades 1, 1, . . . may be continuously provided so as to directly contact plane faces of the end parts 1*a* of the spiral blades 1 as illustrated in FIG. 1. Further, these spiral blades may be continuously provided through a connecting body having a circular pillar or square pillar shape between the plane faces of the end parts 1*a* of the spiral blades 1 (the connecting body is not illustrated). However, it is at least necessary that the spiral blades 1, 1, . . . are continuously provided so as to make the axial lines of the spiral blades 1, 1, . . . on the to align.

In each spiral blade 1 constituting the mixing element, when linear side edges of end parts 1*a*, 1*a* of the spiral blade 1 are seen in the direction which is vertical with respect to the side edge and an axial line as illustrated in FIG. 2, four portions, which respectively continue toward an outer periphery and a front-side side edge 1aL1 at apart spirally continuing to the back side from the front-side side edge 1aL1 of each spiral blade 1, are determined. The four portions are surrounded with: a front-side end edge 1cL1 positioned at the front-side side edge 1aL1, where the front-side end edge 1cL1 starts from a front-side outer peripheral edge 1bR1 at the side continuing toward the back side and finishes with a length of ⅛ or more and less than ½ of a diameter of the spiral blade; an axial-side edge 1cL2 connecting an end of the front-side end edge 1cL1 and a back-side end 1cP1 positioned on the front-side outer peripheral edge 1bR1 at the length of ¼ or more and less than ⅓ of the length in the axial direction of the spiral blade 1 from the end part 1a; and a front-side edge 1cR1 of an outer peripheral face 1b at the side continuing toward the back side, where a front-side edge 1cR1 starts from a starting end of the front-side end edge 1cL1 and finishes at a back-side end 1cP1 of the axial-side edge 1cL2. When the spiral blade is seen in a direction which is parallel with respect to a side edge of the end part 1a of the spiral blade 1 and vertical with respect to the axial line as illustrated in FIGS. 3 and 4, a turbulence generating part 1c divided by an extension face 1ca and a rising face 1cb is formed at these four portions respectively. The extension face 1ca extends from a front-side outer peripheral edge 1bR1, a straight line L, or a smoothly curved line, where the front-side outer peripheral edge 1bR1 is at the side continuing toward the back side, the straight line L connects the starting end of the front-side end edge 1cL1 and the back-side edge 1cP1 of the axial-side edge 1cL2, and the smoothly curved line is positioned between the front-side outer peripheral edge 1bR1 at the side continuing toward the back side and the straight line L connecting the starting end of the front-side end edge 1cL1 and the back-side edge 1cP1 of the axial-side edge 1cL2, and connects the starting end of the front-side end edge 1cL1 and the back-side edge 1cP1 of the axial-side edge 1cL2. The rising face 1cb rises in an approximately vertical direction with respect to the extension face 1ca from the axial-side edge 1cL2 of the extension face 1ca. Further, the positional relationship between the front-side edge 1cR1 of the turbulence generating part 1c and a plane face of the end part 1a is, as illustrated in FIG. 4, formed so as to make the angle θ1 between a tangent line S1 and the plane face of the end part 1a of the spiral blade 1 to be 100 or more and 45° or less, where the tangent line S1 is at the starting end of the front-side end edge 1cL1 of the front-side edge 1cR1 at the side continuing toward the back side of the turbulence generating part 1c of the spiral blade 1.

The turbulence generating part 1c at each of the four portions formed on each spiral blade 1 and divided by the extension face 1ca and the rising face 1cb divides fluids flowing into one side of the end part 1a at one side into a flow along the turbulence generating part 1c and a flow along the spiral face adjacent to the turbulence generating part 1c as illustrated in FIG. 7. Further, the turbulence generating part 1c makes the fluids flowing along the turbulence generating part 1c to flow along the shape which gradually narrows from the front-side end edge 1cL1 to one point of the back-side end 1cP1. Thereby, the turbulence generating part 1c increases the flowing rate of the fluid and makes the fluid to collide with an inner peripheral face of a casing from the back-side end 1cP1 so as to change the flowing direction. Therefore, when the fluid flowing along the turbulence generating part 1c joins with a flow along the spiral face adjacent to the turbulence generating part 1c, the turbulence generating part 1c performs to generate large turbulence.

In this embodiment, the front-side end edge 1cL1 of the turbulence generating part 1c of the spiral blade 1 starts from the front-side outer peripheral edge 1bR1 at the side continuing toward the back side and finishes with the length of ⅛ or more and less than ½ of a diameter of the spiral blade 1, as illustrated in FIG. 2. When the length is less than ⅛ of the diameter of the spiral blade 1, a sufficient flowing amount can not be kept for the turbulence generating part 1c to generate large turbulence. When the length is ½ or more of the diameter of the spiral blade 1, a sufficient flowing amount of the flow along the spiral face adjacent to the turbulence generating part 1c can not be kept, and in addition, interfere with an inflow part 1d positioned at the spiral face adjacent to the turbulence generating part 1c occurs. The front-side end edge 1cL1 is positioned at the front-side side edge 1aL1 of the end part 1a as illustrated in FIG. 2, that is, positioned on the same line as the front-end end edge 1cL1. Thus, the flow along the turbulence generating part 1c does not directly flow in the axial direction, but flows along the turbulence generating part 1c, which is divided by the extension face 1ca and the rising face 1cb, from the front-side end edge 1cL1.

Further, the back-side end 1cP1 of the turbulence generating part 1c of the spiral blade 1 is positioned on the front-side outer peripheral edge 1bR1, and has a length of ¼ or more and less than ⅓ of a length in the axial direction of the spiral blade 1 from the end part 1a, as illustrated in FIGS. 2 and 3. When the position is less than ¼ of the length in the axial direction of the spiral blade 1 from the end part 1, a sufficient flowing amount can not be kept for the turbulence generating part 1c to generate large turbulence. When the position is ⅓ or more of the length in the axial direction of the spiral blade 1 from the end part 1a, it is difficult to make the flow along the turbulence generating part 1c to collide with the inner peripheral face of a casing, and to generate sufficient turbulence since an operation to change the flowing direction decreases.

Further, when the front-side edge 1cR1 of the turbulence generating part 1c of the spiral blade 1 is seen in the direction which is parallel with respect to the side edge of the end part 1a of the spiral blade 1 and vertical with respect to the axial line as illustrated in FIG. 6, the front-side edge 1cR1 has a shape of the front-side outer peripheral edge 1bR1 (a broken line at the upper side in FIG. 6), the straight line L (a broken line at the lower side in FIG. 6), or the smoothly curved line, where the front-side outer peripheral edge 1bR1 is at the side continuing toward the back side, the straight line L connects the starting end of the front-side end edge 1cL1 and the back-side end 1cP1 of the axial-side edge 1cL2, and the smoothly curved line is positioned between the front-side outer peripheral edge 1bR1 at the side continuing toward the back side and the straight line L connecting the starting end of the front-side end edge 1cL1 and the back-side end 1cP1 of the axial-side edge 1cL2 (between the broken line at the upper side and the broken line at the lower side in FIG. 6), and connects the starting end of the front-side end edge 1cL1 and the back-side end 1cP1 of the axial-side edge 1cL2. The turbulence generating part 1c is divided by the extension face 1ca of the front-side edge 1cR1 and the rising face 1cb rising in the direction approximately vertical with respect to the extension face 1ca from the axial-side edge 1cL2 of the extension face 1ca. The extension face 1ca and the rising face 1cb, which divide the turbulence generating part 1c, form the flow along the turbulence generating part 1c.

Further, as illustrated in FIG. 4, the angle θ1 is formed between the tangent line S1 at the starting end of the front-side end edge 1$c$L1 of the front-side edge 1$c$R1 at the side continuing toward the back side of the turbulence generating part 1$c$ of the spiral blade 11 and the plane face of the end part 1$a$ of the spiral blade 1. The angle θ1 is set to be 100 or more and 45° or less. When the angle θ1 is less than 10°, it is difficult for the fluid flowing from the end part 1$a$ at one side to flow along the turbulence generating part 1$c$, and thus a sufficient flowing amount to generate turbulence can not be kept. When the angle θ1 is more than 45°, a part of the fluid flowing along the turbulence generating part 1$c$ diverts in the axial direction from the front-side end edge 1$c$L1 of the turbulence generating part 1$c$ during a process of passing from the front-side end edge 1$c$L1 of the turbulence generating part 1$c$ to one point of the back-side end 1$c$P1. Thus, the flowing rate at the back-side end 1$c$P1 decreases finally so that sufficient turbulence can not be generated.

On the other hand, the inflow part 1$d$ is formed at the back-side side edge 1$a$L2 opposed to a portion at which the turbulence generating part 1$c$ of the end part 1$a$ of the spiral blade 1 is positioned. The inflow part 1$d$ is formed by notching a portion from an end-part starting edge 1$d$L1 to a back-side end edge 1$d$L2. The inflow part 1$d$ is formed at four portions like the turbulence generating part 1$a$, as illustrated in FIG. 5. The end-part starting edge 1$d$L1 is positioned on the plane face of the end part 1$a$, starts from an outer peripheral face 1$b$ at the side continuing toward the back side, finishes with a length of less than ½ of a diameter of the spiral blade 1, is positioned at a length of less than ½ of a thickness of the end part 1$a$ from the back-side side edge 1$a$L2, and is in parallel with the back-side side edge 1$a$L2. The back-side end edge 1$d$L2 is positioned on a back-side spiral face, starts from on the back-side outer peripheral edge 1$b$R2, finishes with an approximately same length as that of the end-part starting edge 1$d$L1, and is in approximately parallel with the end-part starting edge 1$d$L1, where the starting point of on the back-side outer peripheral edge 1$b$R2 is positioned at a side continuing toward the back side and having a length of less than ⅙ of the length in the axial direction of the spiral blade 1 from the end part 1$a$. Further, the positional relationship between the plane face of the end part 1$a$ and the back-side edge 1$d$R1, which starts from the starting end of the end-part starting edge 1$d$L1 and finishes the starting end of the back-side end edge 1$d$L2, in the inflow part 1$d$ is formed so as to make an angle θ2 to be 10° or more and 45° or less. As illustrated in FIG. 4, the angle θ2 is formed with the plane face of the end part 1$a$ of the spiral blade 1 and a tangent line S2 at the starting end of the end-part starting edge 1$d$L1 of the back-side edge 1$d$R1 of the inflow part 1$d$, which starts from the starting end of the end-part staring edge 1$d$L1 at the side continuing toward the back side of the inflow part 1$d$ of the spiral blade 1 and finishes at the starting end of the back-side end edge 1$d$L2.

The inflow part 1$d$ formed at four portions of each spiral blade 1 smoothly guides a part of fluid flowing along the spiral face adjacent to the turbulence generating part 1$c$ from one end part so as to make the fluid to flow along the spiral face, and increase a flowing amount of fluid flowing along the spiral face adjacent to the turbulence generating part 1$c$ from one end part, as illustrated in FIG. 7. Thereby, the inflow part 1$d$ can perform to keep sufficient turbulence for efficiently mixing two or more kinds of fluids when the flow along the spiral face adjacent to the turbulence generating part 1$c$ collides with the flow along the turbulence generating part 1$c$ near the back-side end 1$c$P1 of the turbulence generating part 1$c$.

The reason why the end-part starting edge 1$d$L1 of the inflow part 1$d$ of the spiral blade 1 starts from the outer peripheral face 1$b$ at the side continuing toward the back side and finishes with the length of less than ½ of the diameter of the spiral blade, as illustrated in FIG. 5, is as follows. When the length is ½ or more of the diameter of the spiral blade 1, interference occurs with the adjacent turbulence generating part 1$c$. Further, reason for being less than ½ of the thickness of the end part 1$a$ from the back-side side edge 1$a$L2 of the end part 1$a$ is that, when the length is ½ or more, interference occurs with the turbulence generating part 1$c$ formed to be opposite to the back-side side edge 1$a$L2 of the end part 1$a$ where the inflow part 1$d$ is formed. Furthermore, the reason for being in parallel with the back-side side edge 1$a$L2 of the end part 1$a$ is to smoothly guide a part of fluid to flow along the spiral face.

Further, the back-side end edge 1$d$L2 of the inflow part 1$d$ of the spiral blade 1 starts from the back-side outer peripheral edge 1$b$R2 having the length of less than ⅙ of the length in the axial direction of the spiral blade 1 from the end part 1$a$ and continuing toward the back side, as illustrated in FIG. 5. When the length is ⅙ or more of the length in the axial direction of the spiral blade 1 from the end part 1$a$, a flowing amount of fluid flowing along the inflow part 1$d$ increases, and thus a flowing amount of fluid, which collides with the flow along the turbulence generating part 1$c$ near the back-side end 1$c$P1 of the turbulence generating part 1$c$, decreases.

Further, as illustrated in FIG. 4, the angle θ2 is formed to be 10° or more and 45° or less, where the angle θ2 is formed with the plane face of the end part 1$a$ of the spiral blade 1 and the tangent line S2 at the starting end of the end-part starting edge 1$d$L1 of the back-side edge 1$d$R1 of the inflow part 1$d$, which starts from the starting end of the end-part staring edge 1$d$L1 at the side continuing toward the back side of the inflow part 1$d$ of the spiral blade 1 and finishes at the starting end of the back-side end edge 1$d$L2. When the angle θ2 is less than 10° or more than 45°, a portion at which the inflow part 1$d$ contacts to the spiral face in the back-side end edge 1$d$L2 of the inflow part 1$d$ becomes to have a shape largely bending. Thus, it becomes difficult to smoothly guide a part of fluid flowing along the spiral face adjacent to the turbulence generating part 1$c$ from one end part to flow along the spiral face.

Further, in the spiral blade 1 having the above-described constitution, an angle θ3 formed with the plane face of the end part 1$a$ of the spiral blade 1 and a tangent line S3 at an end of the front-side end edge 1$c$L1 of the edge 1$c$R2 at the spiral face side, which is positioned at the opposing side of the axial-side edge 1$c$L2 of the rising face 1$cb$ of the turbulence generating part 1$c$ of the spiral blade 1, starts from the end of the front-side end edge 1$c$L1, and finishes at the back-side end 1$c$P1, as illustrated in FIG. 4, is formed to be 60° or more and less than 90°. When the angle θ3 is formed in such the range, the angular difference between the angle θ1 formed with the plane face of the end part 1$a$ and the extension face 1$ca$ of the turbulence generating part 1$c$, and the angle θ3 formed with the plane face of the end part 1$a$ and the spiral face adjacent to the extension face 1$ca$ of the turbulence generating part 1$c$ can be increased. Thereby, fluid flowing-in from the end part 1$a$ at one side can be effectively divided into a flow along the turbulence generating part 1$c$ and a flow along the spiral face adjacent to the turbulence generating part 1$c$. Therefore, efficiency to mix two or more kinds of fluids can be more improved, and such is preferable.

In this embodiment, the reason why the angle θ3 formed with the plane face of the end part 1$a$ of the spiral blade 1 and a tangent line S3 at an end of the front-side end edge 1$c$L1 of the edge 1$c$R2 at the spiral face side, which is positioned at the opposing side of the axial-side edge 1$c$L2 of the rising face 1$cb$ of the turbulence generating part 1$c$ of the spiral blade 1, starts from the end of the front-side end edge 1$c$L1, and finishes at the back-side end 1cP1, as illustrated in FIG. 4, is preferably formed to be 60° or more and less than 90° is as follows. When the angle θ3 is less than 60°, the anglular difference between the angle θ1 formed with the plane face of the end part 1a and the extension face 1ca of the turbulence generating part 1c, and the angle θ3 formed with the plane face of the end part 1a and the spiral face adjacent to the extension face 1ca of the turbulence generating part 1c cannot be increased. Thereby, fluid flowing-in from the end part 1a at one side cannot be effectively divided into a flow along the turbulence generating part 1c and a flow along the spiral face adjacent to the turbulence generating part 1c. When the angle θ3 is 90° or more, fluid flowing-in from the end part 1a at one side hardly flow along the spiral face adjacent to the turbulence generating part 1c, and thus a sufficient flowing amount to generate turbulence can not be kept.

Then, an operation of a mixing element according to the present invention having the above-described constitution will be described.

When two or more kinds of fluids continuously flow into a mixing element according to the present invention fixed in a cylindrical casing from one side of the casing, the fluid flowing-in from the end part 1a at one side is largely divided into two flows by the end part 1a of the spiral blade 1 (for example, divided into a right-side space and a left-side space of the end part 1a in FIG. 5). Then, the divided two large flows are re-joined at the end part 1a at the other side through two spaces formed between an inner peripheral face of the casing and spiral faces of the spiral blade 1.

At this time, after the fluid is largely divided into the two flows by the end part 1a of the spiral blade 1, the fluid flowing in each side is divided into a flow along the turbulence generating part 1c formed at the spiral blade 1 and a flow along the spiral face adjacent to the turbulence generating part 1c as illustrated in FIG. 7 (for example, divided into two as illustrated with arrows shown at the lower side of the upper side spiral blade 1 in FIG. 7). As for the fluid flowing along the spiral face adjacent to the turbulence generating part 1c, a part of the fluid is smoothly guided to the spiral face adjacent to the turbulence generating part 1c along the inflow part 1d from a portion near the end part 1a, and thereafter joins with another flow along the spiral face so as to flow along the spiral face. On the other hand, as for the fluid to flow along the turbulence generating part 1c, since the front-side end edge 1cL1 of the turbulence generating part 1c is not positioned between the front-side side edge 1aL1 and the back-side side edge 1aL2 of the end part 1a but is positioned at the front-side side edge 1aL1 of the end part 1a, the fluid does not directly flow in the axial direction, but flows from the front-side end edge 1cL1 of the turbulence generating part 1c along the extension face of the turbulence generating part 1c. Then, since the extension face of the turbulence generating part 1c has a shape having a width gradually narrowed from the front-side end edge 1cL1 to one point of the back-side end 1cP1, the fluid flowing from the front-side end edge 1cL1 of the turbulence generating part 1c along the extension face of the turbulence generating part 1c increases in its flowing rate until reaching to the back-side end, and collides with the inner peripheral face of the casing from the back-side end 1cP1 so as to change its flowing direction.

The flow with the increased flowing rate and in the changed flowing direction along the turbulence generating part 1c re-joins with a flow along the spiral face adjacent to the turbulence generating part 1c near the back-side end 1cP1 of the turbulence generating part 1c as illustrated in FIG. 7. This flow with the increased flowing rate and in the changed flowing direction along the turbulence generating part 1c collides with the flow along the spiral face adjacent to the turbulence generating part 1c so as to generate large turbulence.

Then, when the flow along the turbulence generating part 1c re-joins with the flow along the spiral face adjacent to the turbulence generating part 1c while generating large turbulence near the back-side end 1cP1 of the turbulence generating part 1c, the flow is re-divided into a flow along the turbulence generating part 1c and a flow along the spiral face adjacent to the turbulence generating part 1c by the turbulence generating part 1c formed near the end part 1c at the other side as illustrated in FIG. 7 (for example, divided into two as illustrated with arrows shown at the upper side of the upper side spiral blade 1 in FIG. 7), and reaches to the other end part 1a. The divided fluid further flows into an end part 1a on one side of a turbulence generating part 1c continuously provided following to the above-described turbulence generating part 1c, and thus more complicated flow is generated.

Accordingly, during a process that two or more kinds of fluids flow from one end part 1a to the other end part 1a of the spiral blade 1 in a mixing element according to the present invention, the fluid is divided into a flow along the turbulence generating part 1c and a flow along the spiral face adjacent to the turbulence generating part 1c, the flows thereafter rejoin near the back-side end 1cP1 of the turbulence generating part 1c while generating large turbulence, and then the flow is re-divided into a flow along the turbulence generating part 1c and a flow along the spiral face adjacent to the turbulence generating part 1c so as to reach to the other end part 1a. Then, while generating complicated flow, the fluids flow into an end part on one side of a turbulence generating part 1c continuously provided following to the above-described turbulence generating part 1c. Thus, each spiral blade 1 itself can remarkably improve efficiency to mix two or more kinds of fluids in comparison with that of a conventional mixing element.

Since each spiral blade 1 of a mixing element according to the present invention can remarkably improve efficiency to mix two or more kinds of fluids in comparison with that of a conventional mixing element, the number of the spiral blade 1 can be reduced from that of a conventional mixing element. Thus, the overall length in the axial direction of a mixing element can be remarkably shortened. As a result of this, an amount of two or more kinds of fluids remaining unmixed in a space formed between an inner peripheral face of a casing and two or more spiral blades of the mixing element as much as possible. Further, more particularly, when two or more kinds of the fluids are high cost materials constituting, for example, a dental adhesive, economic loss can be remarkably decreased.

What is claimed is:

1. A mixing element of a static mixer fixed in a cylindrical casing and comprising right-handed spiral blades and left-handed spiral blades, which respectively have a shape twisted approximately 180 degrees in an axial direction, and are alternately and continuously provided in the axial direction so as to make end parts of the adjacent spiral blades to cross almost, orthogonally, wherein a turbulence generating part divided by an extension face which extends from a front-side outer peripheral edge, a straight line, or a smoothly curved line, where the front-side outer peripheral edge is at the side continuing toward the back side, the straight line connects a starting end of a front-side end edge and a back-side end of an axial-side edge, and the smoothly curved line is positioned between the front-side outer peripheral edge at the side continuing toward the back side and the straight line connecting a start end of the front-side side edge and the back-side end of the axial-side edge, and connects the starting end of the front-side end and the back-side end of the axial-side edge, when seen in a direction parallel with respect to a side edge of the end part of the spiral blade and vertical with respect to the axial line, and a rising face which rises in an approximately vertical direction with respect to the extension face from the axial-side edge of the extension face, is formed at each of four portions, which respectively continue toward a front-side side edge and an outer periphery at a part spirally continuing to the back side from the front-side side edge of each spiral blade, when a linear side edge of each end part of the spiral blade is seen in a direction vertical to a side edge and an axial line, and are surrounded by a front-side end edge positioned at the front-side side edge, where the front-side end edge starts from a front-side outer peripheral edge at a side continuing toward the back side and finishes with a length of ⅛ or more and less than ½ of a diameter of the spiral blade, an axial-side edge connecting an end of the front-side end edge and a back-side end positioned on the front-side outer peripheral edge having a length of ¼ or more and less than ⅓ of the length in the axial direction of the spiral blade from the end part, and a front-side edge of an outer peripheral face at the side continuing toward the back side, where the front-side edge starts from a starting end of the front-side end edge and finishes at a back-side end of an axial-side edge, wherein an inflow part is respectively formed at each back-side side edge opposed to a portion at which the turbulence generating part of the end part of the spiral blade is positioned, where the inflow part is formed by notching a portion from an end-part starting edge, which is positioned on a plane face of the end part, starts from the outer peripheral face at a side continuing toward the back side, finishes with a length of less than ½ of a diameter of the spiral blade, is positioned at a length of less than ½ of a thickness of the end part from the back-side side edge, and is in parallel with the back-side side edge, to a back-side end edge, which is positioned on a back-side spiral face, starts from on a back-side outer peripheral edge positioned at a side continuing toward the back side and having a length of less than ⅙ of a length in the axial direction of the spiral blade from the end part, finishes with an approximately same length as that of the end-part starting edge, and is in approximately parallel with the end-part starting edge, and wherein the angle formed with the plane face of the end part of the spiral blade and a tangent line at a starting end of the front-side end edge of the front-side edge at the side continuing toward the back side of each turbulence generating part of the spiral blade and an angle formed with the plane face of the end part of the spiral blade and a tangent line at a starting end of an end-part starting edge of the back-side edge of each inflow part starting from a starting end of the end-part starting edge at the side continuing toward the back side of each inflow part of the spiral blade and finishing at a starting end of the back-side end edge, are formed so as to be 10° or more and 45° or less.

2. The mixing element as claimed in claim 1, wherein an angle formed with the plane face of the end part of the spiral blade and a tangent line at an end of the front-side end edge of an edge at the spiral face side, which is positioned at a side opposite to the axial-side edge of the rising face of the turbulence generating part of the spiral blade, starts from the end of the front-side end edge, and finishes the back-side end, is made to be 60° or more and less than 90°.

* * * * *